US006776625B2

(12) United States Patent
Ma

(10) Patent No.: US 6,776,625 B2
(45) Date of Patent: Aug. 17, 2004

(54) LAND GRID ARRAY CONNECTOR ASSEMBLY WITH REINFORCEMENT

(75) Inventor: Hao-Yun Ma, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/444,020

(22) Filed: May 21, 2003

(65) Prior Publication Data

US 2004/0110396 A1 Jun. 10, 2004

(30) Foreign Application Priority Data

Dec. 6, 2002 (TW) ..... 91219756 A

(51) Int. Cl.[7] ..... H01R 13/639
(52) U.S. Cl. ..... 439/73; 439/330
(58) Field of Search ..... 439/73, 331, 330, 439/342, 525, 526

(56) References Cited

U.S. PATENT DOCUMENTS 5,344,334 A 9/1994 Laub et al. ..... 439/331

5,761,036 A * 6/1998 Hopfer et al. ..... 361/704

* cited by examiner

*Primary Examiner*—Renee Luebke
(74) *Attorney, Agent, or Firm*—Wei Te Chung

(57) ABSTRACT

An LGA connector assembly (1) includes an insulative base (10) receiving a number of electrical contacts (14), a metal reinforcement (11) covering the base, a lever (13) and a metal clip (12) pivotally mounted to two opposite sides of the base respectively. The base defines a cavity (100) in a middle thereof and eight rectangular holes (1031) near the cavity. The reinforcement includes a planar portion (111) and eight projecting members (1110) extending perpendicularly from the planar portion. Each projecting member can be fittingly received in the corresponding hole of the base. Thus, during rotating the lever to engage with the metal clip to tightly attach a CPU in the cavity of the LGA connector assembly, the base is hard enough to withstand forces from the clip and the lever.

11 Claims, 4 Drawing Sheets

LAND GRID ARRAY CONNECTOR ASSEMBLY WITH REINFORCEMENT

BACKGROUND OF THE INVENTION

1. Field of the Invention

The present invention relates to an electrical connector assembly for electrically connecting an electronic package such as a central processing unit (CPU) with a circuit substrate such as a printed circuit board (PCB), and particularly to a land grid array (LGA) connector assembly adapted for receiving an LGA CPU therein and electrically connecting the CPU with a PCB.

2. Description of the Prior Art

Referring to FIGS. 3 and 4, a conventional LGA connector assembly 9 is adapted for electrically connecting a CPU (not shown) having a plurality of metal pads with a PCB (not shown). The LGA connector assembly 9 comprises an insulative base 91, and a lever 92 and a metal clip 93 pivotally mounted to two opposite sides of the base 91 respectively. The lever 92 comprises a pair of locating portions 921, an offset securing portion 922 between the locating portions 921, a medial portion 923 extending perpendicularly from an end of one of the locating portions 921, and a handle portion 924 extending perpendicularly from a free end of the medial portion 923. The metal clip 93 comprises a lip 931 at an end thereof, and a pair of spaced mounting portions 932 extending arcuately from an opposite end thereof. The base 91 is substantially rectangular. A substantially rectangular cavity 911 is defined in a middle of the base 91, for receiving the CPU therein. A portion of the base 91 under the cavity 911 defines a plurality of passageways 916 receiving a corresponding number of contacts 94 therein. A pair of spaced slots 912 is defined in one end of the base 91. The mounting portions 932 of the metal clip 93 are movably received in the slots 912, such that the metal clip 93 is pivotally mounted on the base 91. A trapezoidal recess 913 is defined in an opposite end of the base 91, and a chamber 914 is defined at an end of the base 91 in communication with the recess 913. The locating portions 921 of the lever 92 are pivotally received in the chamber 914, and the securing portion 922 of the lever 92 is received in the recess 913.

In use, the base 91 is mounted to and electrically connected with the PCB. The metal clip 93 and the medial portion 923 are oriented perpendicularly to the base 91, with the securing portion 922 disposed above the locating portions 921. The CPU is mounted in the cavity 911, and the metal pads of the CPU are loosely attached on the corresponding contacts 94 of the base 91. The metal clip 93 is rotated down to loosely contact the CPU. The handle portion 924 of the lever 92 is rotated downwardly, with the medial portion 923 also rotating downwardly. When the securing portion 922 reaches the lip 931 of the clip 93, the securing portion 922 begins to engage with the lip 931. The handle portion 923 is continued to be rotated downwardly, with the securing portion 922 driving the lip 931 downwardly. When the medial portion 923 has reached a horizontal position, the securing portion 922 of the lever 92 is tightly attached on the lip 931, and the metal pads of the CPU are firmly attached on the contacts 94 of the base 91. The LGA connector assembly 9 thus electrically connects the CPU with the PCB.

At present, with the prevailing trend toward miniaturization of computers, the sizes of LGA connector assemblies used in computers are steadily becoming smaller. In contrast, the number of contacts used in LGA connectors is increasing to meet the need for more signal transmission. These considerations bear on the conventional LGA connector assembly 9 as follows. During the rotation of the lever 92 to force the metal pads of the CPU on the contacts 94 of the base 91, the metal clip 93 and the lever 92 exert forces on the base 91. The forces acting on the portions of the base 91 near the slots 912 and at the chamber 914 are larger than those acting on other portions of the base 91. Therefore the base 91 is liable to deform and warp. When deformation or warpage occurs, some contacts 94 cannot firmly contact the metal pads of the CPU, which disrupts the electrical connection between the CPU and the PCB.

In view of the above, a new LGA connector assembly that overcomes the above-mentioned disadvantages is desired.

SUMMARY OF THE INVENTION

Accordingly, an object of the present invention is to provide an-electrical connector assembly such as a land grid array (LGA) connector assembly for electrically connecting an electronic package such as an LGA central processing unit (CPU) with a circuit substrate such as a printed circuit board (PCB), wherein the electrical connector assembly has a base that resists deformation and warpage.

To achieve the above-mentioned object, an LGA connector assembly in accordance with a preferred embodiment of the present invention comprises an insulative rectangular base receiving a plurality of electrical contacts, a metal reinforcement covering the base, and a lever and a metal clip pivotally mounted to two opposite sides of the base respectively. The reinforcement comprises a planar portion, two opposite sidewalls depending perpendicularly from two opposite outer edges of the planar portion, a pair of spaced tabs depending perpendicularly from an outer edge of the planar portion, and an elongate beam depending perpendicularly from an opposite outer edge of the planar portion. Eight projecting members depend perpendicularly from two opposite inner edges of the planar portion. The base defines a cavity in a middle thereof, a pair of aligned channels at one end thereof engaging the tabs of the reinforcement, and eight rectangular holes for fittingly receiving the projecting members. Thus, during rotating the lever to engage with the clip to tightly attach a CPU in the cavity of the LGA connector assembly, the base is enough hard to withstand forces from the clip and the lever.

Other objects, advantages and novel features of the invention will become more apparent from the following detailed description when taken in conjunction with the accompanying drawings, in which:

DETAILED DESCRIPTION OF THE PREFERRED EMBODIMENT OF THE INVENTION

Reference will now be made to the drawings to describe the present invention in detail.

Figure 1:
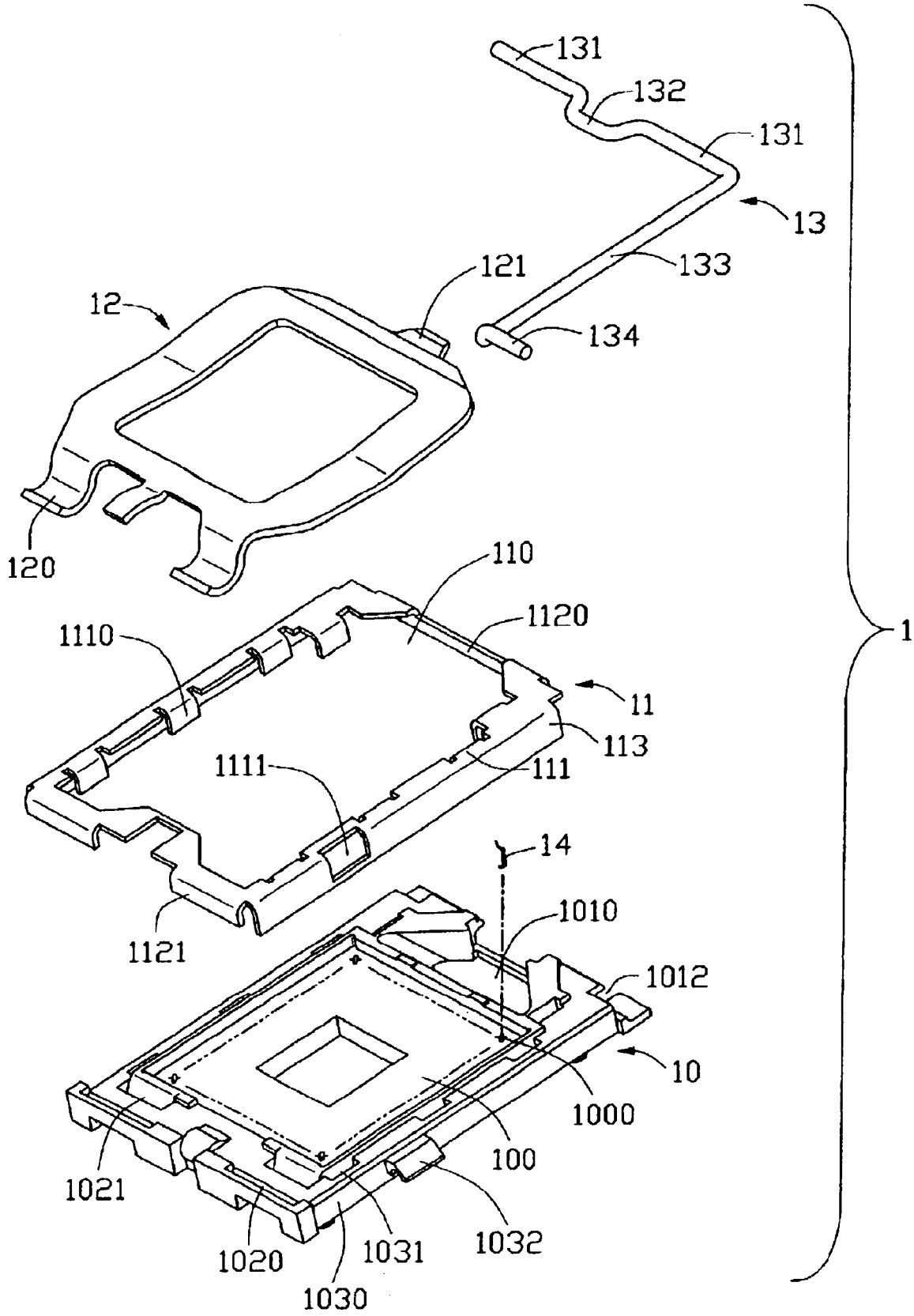
FIG. 1 is an exploded, isometric view of an LGA connector assembly in accordance with the preferred embodiment of the present invention.

Referring to FIG. 1, a land grid array (LGA) connector assembly 1 in accordance with the preferred embodiment of the present invention is adapted for electrically connecting an electronic package such as an LGA central processing unit (CPU) (not shown) with a circuit substrate such as a printed circuit board (PCB) (not shown).

The LGA connector assembly 1 comprises an insulative base 10, a plurality of electrical contacts 14 received in the base 10, a metal reinforcement 11 covering the base 10, and a metal clip 12 and a lever 13 pivotally mounted to two opposite sides of the base 10 respectively.

The lever 13 comprises a pair of locating portions 131, an offset securing portion 132 between the locating portions 131, a medial portion 133 extending perpendicularly from an end of one of the locating portions 131, and a handle portion 134 extending perpendicularly from a free end of the medial portion 133.

The clip 12 comprises a lip 121 at a free end thereof, and a pair of spaced mounting portions 120 extending arcuately from an opposite end thereof.

Figure 2:
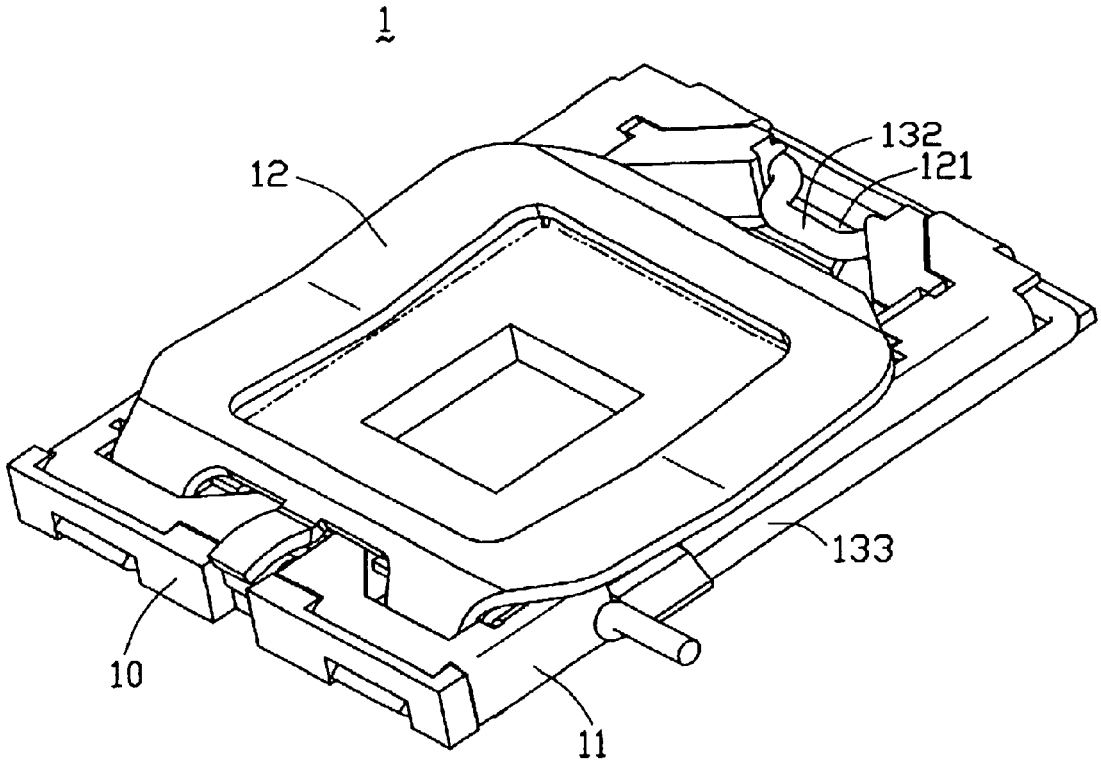
FIG. 2 is an assembled view of FIG. 1.
Figure 3:
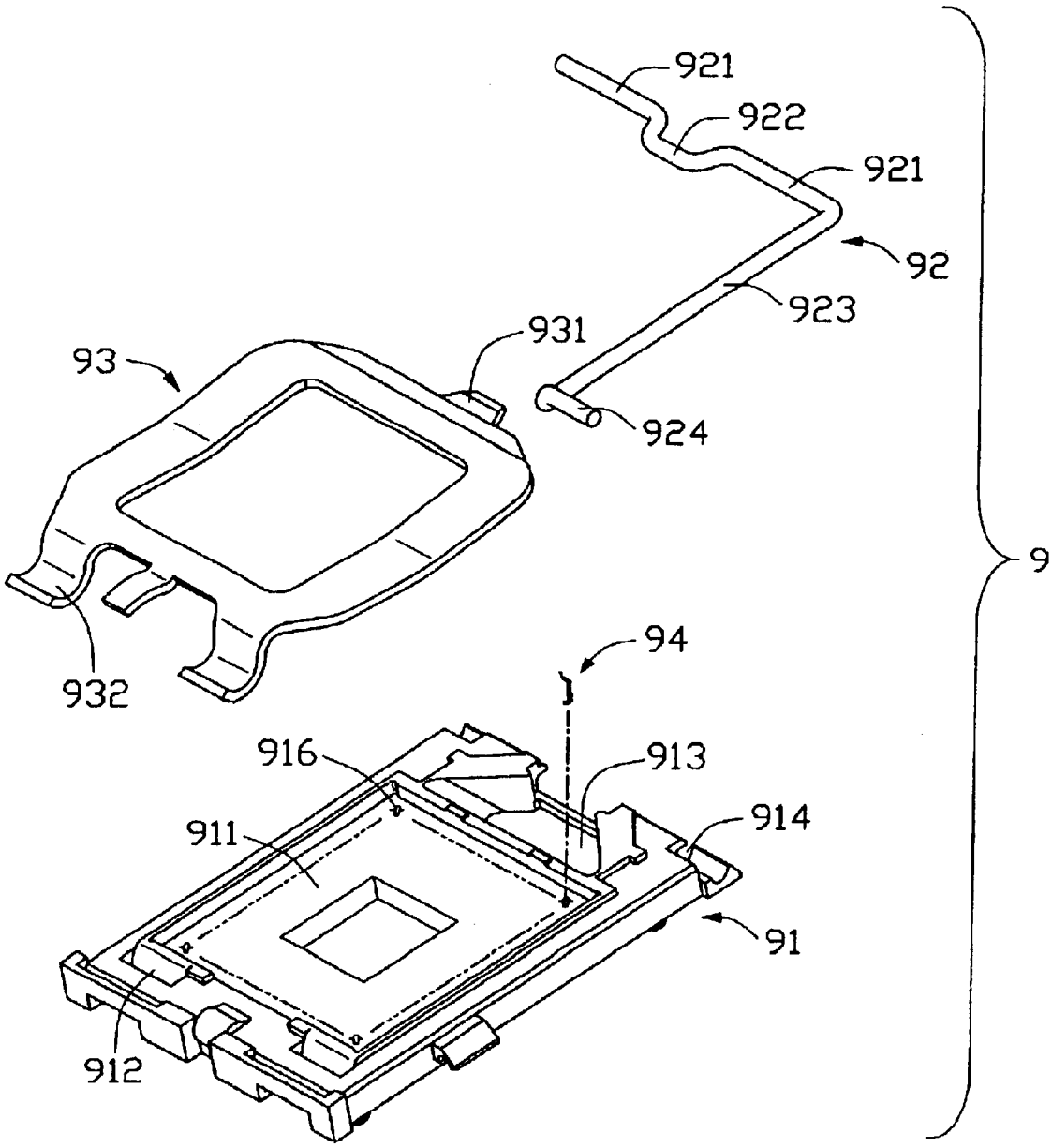
FIG. 3 (PRIOR ART)
FIG. 3 is an exploded, isometric view of a conventional LGA connector assembly.
Figure 4:
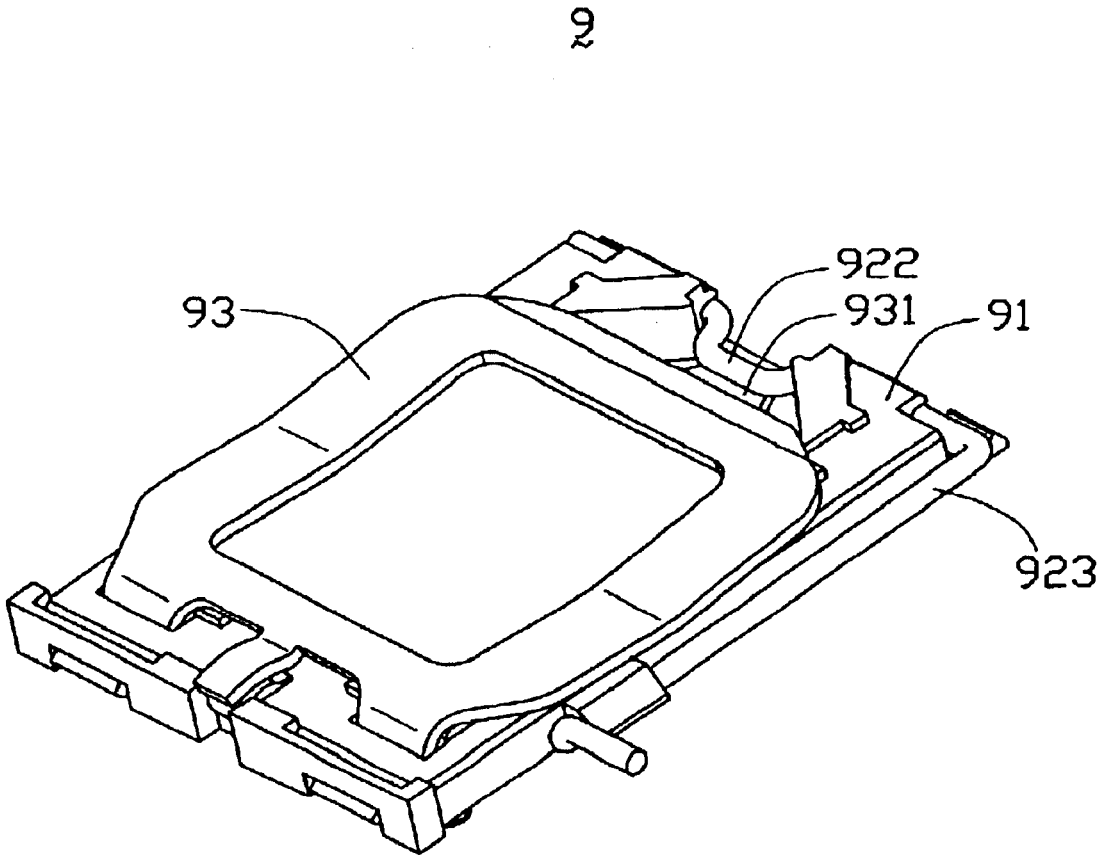
FIG. 4 (PRIOR ART)
FIG. 4 is an assembled view of FIG. 3.

Also referring to FIG. 2, the base 10 is substantially rectangular. The base 10 comprises a pair of opposite sidewalls 1030. The base 10 defines a rectangular cavity 100 in a middle thereof, a pair of aligned channels 1020 at one end thereof, and a trapezoidal recess 1010 at an opposite end thereof. A portion of the base 10 under the cavity 100 defines a multiplicity of passageways 1000 receiving a corresponding number of the contacts 14 therein. A pair of spaced, aligned slots 1021 is defined between the channels 1020 and the cavity 100, for receiving the mounting portions 120 of the clip 12 therein to pivotally mount the clip 12 on the base 10. A chamber 1012 is defined at said opposite end of the base 10, in communication with the recess 1010. The locating portions 131 of the lever 13 are pivotally received in the chamber 1012, and the securing portion 132 of the lever 13 is received in the recess 1010. Eight rectangular holes 1031 are defined in two opposite sides of the base 10, near the cavity 100. An ear 1032 is outwardly formed from one of the sidewalls 1030 that corresponds to the medial portion 133 of the handle 13.

The reinforcement 11 is stamped and formed from a sheet of metallic material, and comprises a planar portion 111 parallel to a top of the base 10. The planar portion 111 defines an opening 110 in a middle thereof, corresponding to the cavity 100 of the base 10. The opening 110 and the cavity 100 enable the CPU to be received in the base 10. Two sidewalls 113 depend perpendicularly from two opposite outer edges of the planar portion 111 respectively. One of the sidewalls 113 defines a window 1111, corresponding to the ear 1032 of the base 10. The sidewalls 113 respectively cover the sidewalls 1030 of the base 10, with the ear 1032 of the base 10 projecting through the window 1111. Two spaced tabs 1121 depend perpendicularly from an end edge of the planar portion 111. A beam 1120 depends perpendicularly from an opposite end edge of the planar portion 111. The tabs 1121 are received in the channels 1020 of the base 10. The beam 1120 blocks an outside opening of the chamber 1012, thereby retaining the locating portions 131 of the lever 13 within the chamber 1012 and the securing portion 132 of the lever 13 within the recess 1010. Eight projecting members 1110 depend perpendicularly from two opposite inner lateral edges of the planar portion 111 respectively, the projecting members 1110 being fittingly received in the corresponding holes 1031 of the base 10 and thereby mounting the reinforcement 11 to the base 10.

In use, the LGA connector assembly 1 is mounted to and electrically connected with the PCB. The clip 12 and the medial portion 133 of the lever 13 are each oriented perpendicularly to the base 10, with the securing portion 132 of the lever 13 disposed above the locating portions 131. The CPU is mounted in the cavity 100, with metal pads (not shown) of the CPU loosely attached on the contacts 14 of the base 10. The clip 12 is rotated down to loosely contact the CPU. The handle portion 134 of the lever 13 is rotated downwardly, with the securing portion 132 also rotating downwardly. When the securing portion 132 reaches the lip 121 of the clip 12, the securing portion 132 begins to engage with the lip 121. The handle portion 134 is continued to be rotated downwardly, with the securing portion 132 driving the lip 121 downwardly. When the medial portion 133 of the lever 13 has reached a horizontal position, the securing portion 132 is tightly attached on the lip 121, and the metal pads of the CPU are firmly attached on the contacts 14. The LGA connector assembly 1 thus reliably electrically connects the CPU with the PCB.

As can be seen from FIG. 2, the reinforcement 11 covers the base 10 including around the slots 1021 and the chamber 1012. Thus, when the lever 13 and the clip 12 are rotated, even though portions of the base 10 around the slots 1021 and the chamber 1012 sustain greater forces from the clip 12 than other portions of the base 10, the base 10 is still able to withstand the forces thereat. The base 10 is resistant to deformation or warpage, and the LGA connector assembly 1 can provide reliable electrical connection between the CPU and the PCB.

While a preferred embodiment in accordance with the present invention has been shown and described, equivalent modifications and changes known to persons skilled in the art according to the spirit of the present invention are considered within the scope of the present invention as defined in the appended claims.

What is claimed is:

1. A land grid array (LGA) connector assembly, comprising:

an insulative base defining a cavity in a middle thereof and a plurality of holes near the cavity;

a metal reinforcement covering the base, the reinforcement comprising a planar portion, the planar portion defining an opening in a middle thereof corresponding to the cavity of the base, a plurality of projecting members extending perpendicularly from inner edges of the planar portion for being fittingly received in the holes of the base, respectively;

a lever pivotally mounted to one side of the base and having a securing portion;

a clip pivotally mounted to an opposite side of the base, the clip being able to engage with the securing portion; wherein the reinforcement comprises two tabs depending perpendicularly from an outer edge of the planar portion, and an elongate beam depending perpendicularly from an opposite outer edge of the planar portion.

2. The LGA connector assembly as claimed in claim 1, wherein there are eight holes defined in the base.

3. The LGA connector assembly as claimed in claim 1, wherein there are eight projecting members formed on the reinforcement.

4. The LGA connector assembly as claimed in claim 1, wherein the base defines a pair of aligned channels at one end thereof for receiving the tabs therein.

5. The LGA connector assembly as claimed in claim 1, wherein the base defines a chamber at an opposite end thereof for pivotably receiving the lever therein, and the beam of the reinforcement blocks an outside opening of the chamber to retain the lever within the chamber.

6. The LGA connector assembly as claimed in claim 1, wherein the reinforcement comprises two opposite sidewalls depending perpendicularly from two opposite outer edges of the planar portion.

7. The LGA connector assembly as claimed in claim 6, wherein a window is defined at one of the sidewalls of the reinforcement.

8. The LGA connector assembly as claimed in claim 7, wherein an ear is formed at a sidewall of the base for engaging with the window.

9. The LGA connector assembly as claimed in claim 1, wherein the lever has a securing portion, and the clip has a lip at a free end thereof for engaging with the securing potion of the lever.

10. A reinforcement connector, comprising:

an insulative base defining a plurality of holes on a periphery region thereof;

a plurality of contacts received in a middle region of the base; and a frame-like metal reinforcement attached to the base and including a planar portion with a plurality of generally aligned projecting members and at least one side wall, said aligned projecting members and said at least one side wall downwardly extending from the metal reinforcement and having a closely spaced parallel relation between said aligned projecting members and said at least one side wall; wherein said projecting members are respectively received in the corresponding holes of the base and the side wall abuts against a side face of the base and adjacent to said projecting members.

11. The connector as claimed in claim 10, wherein said base further includes an ear on said side face, and said side wall includes a window receiving said ear.

* * * * *